US010046910B2

(12) United States Patent
Wagner et al.

(10) Patent No.: US 10,046,910 B2
(45) Date of Patent: Aug. 14, 2018

(54) SEMI-AUTONOMOUS TUG APPARATUS

(71) Applicant: Kevin Wagner, Fullerton, CA (US)

(72) Inventors: Kevin Wagner, Fullerton, CA (US); Bryan Lew, Gardena, CA (US); Timothy Domingo, La Crescenta, CA (US)

( * ) Notice: Subject to any disclaimer, the term of this patent is extended or adjusted under 35 U.S.C. 154(b) by 270 days.

(21) Appl. No.: 14/972,449

(22) Filed: Dec. 17, 2015

(65) Prior Publication Data

US 2017/0174427 A1 Jun. 22, 2017

(51) Int. Cl.
*B65F 1/14* (2006.01)

(52) U.S. Cl.
CPC ..... *B65F 1/1452* (2013.01); *B65F 1/1468* (2013.01); *B65F 1/1473* (2013.01)

(58) Field of Classification Search
CPC .... B65F 1/1452; B65F 1/1468; B65F 1/1473; B65F 2210/165; B65F 3/005; B62D 59/04; B64F 1/228; Y10S 180/904; B62B 5/0043; B62B 5/0033
See application file for complete search history.

(56) References Cited

U.S. PATENT DOCUMENTS 2,846,018 A * 8/1958 Puckett ..... B60P 3/127 180/14.1
D212,800 S * 11/1968 Kimball ..... D34/28
3,705,638 A * 12/1972 Shock ..... B62D 59/04 180/11
4,483,407 A * 11/1984 Iwamoto ..... B62B 5/02 180/6.54
4,797,050 A * 1/1989 Habicht ..... B66F 9/19 414/420
4,860,841 A * 8/1989 Sacco ..... B60D 1/246 180/13
5,325,934 A * 7/1994 Larson ..... B60D 1/246 180/13
5,353,887 A 10/1994 Putnam
5,762,461 A 6/1998 Frohlingsdorf
5,816,349 A * 10/1998 Hankins ..... B62D 59/04 180/11
5,860,659 A * 1/1999 Hart ..... B60D 1/00 280/400
5,899,468 A 5/1999 Apps et al.
6,264,528 B1 7/2001 Doan et al.
6,746,039 B2 * 6/2004 Perelli ..... B62B 3/02 280/651

(Continued)

FOREIGN PATENT DOCUMENTS

CN 204282264 U 4/2015

*Primary Examiner* — Paul N Dickson
*Assistant Examiner* — Timothy Wilhelm
(74) *Attorney, Agent, or Firm* — Fulwider Patton LLP

(57) ABSTRACT

A trash bin tug carried on a pair of drive wheels driven by reversible motors and carrying a swivel support arm projecting upwardly and rearwardly towards a bin. The support arm carries a latch which cooperates with the support arm and tug to, upon being latched, support the front of the bin elevated from the support surface. The steps of selecting a tug with a support arm and carried on reversible drive wheels to be maneuvered from a remote control into position to engage a handle on a trash bin and latch onto the handle to elevate the front of the trash bin from the support surface.

11 Claims, 4 Drawing Sheets

(56) References Cited

U.S. PATENT DOCUMENTS 6,758,291 B1 * 7/2004 Koch ..... B60D 1/246 180/11
7,066,291 B2 * 6/2006 Martins ..... B25J 5/007 180/167
7,100,725 B2 * 9/2006 Thorne ..... G05D 1/0242 180/169
7,451,841 B2 * 11/2008 Nelson ..... B62D 51/04 180/13
7,894,939 B2 * 2/2011 Zini ..... G05B 19/41895 700/245
8,146,695 B1 4/2012 Ramshur
8,181,725 B2 * 5/2012 Andres ..... B64C 25/50 180/11
8,684,373 B2 * 4/2014 Holtan ..... B62B 3/1404 280/33.991
8,695,736 B1 * 4/2014 Samaroo ..... B65F 1/1452 180/11
8,944,742 B2 * 2/2015 Hill ..... B60R 9/06 414/462
8,973,927 B2 * 3/2015 Belanger ..... B62B 3/0643 280/47.17
9,010,771 B2 * 4/2015 Holtan ..... B62B 3/001 280/33.992
9,026,301 B2 * 5/2015 Zini ..... G05B 19/41895 700/245
9,085,207 B1 * 7/2015 Sweet ..... B60D 1/24
9,371,060 B2 * 6/2016 Smith ..... B62D 59/04
2004/0195012 A1 * 10/2004 Song ..... A47L 9/009 180/6.5
2007/0209846 A1 * 9/2007 Wilson ..... B65F 1/1468 180/65.1
2008/0038102 A1 2/2008 Murphy et al.
2012/0215393 A1 * 8/2012 Schiedegger ..... B60P 3/11 701/23
2013/0062128 A1 * 3/2013 Johnson ..... B64F 1/227 180/11
2015/0105965 A1 * 4/2015 Blackwell ..... A01B 59/002 701/28
2015/0234386 A1 * 8/2015 Zini ..... G05D 1/0274 701/26
2016/0258216 A1 * 9/2016 Baaske ..... E21B 7/024

* cited by examiner

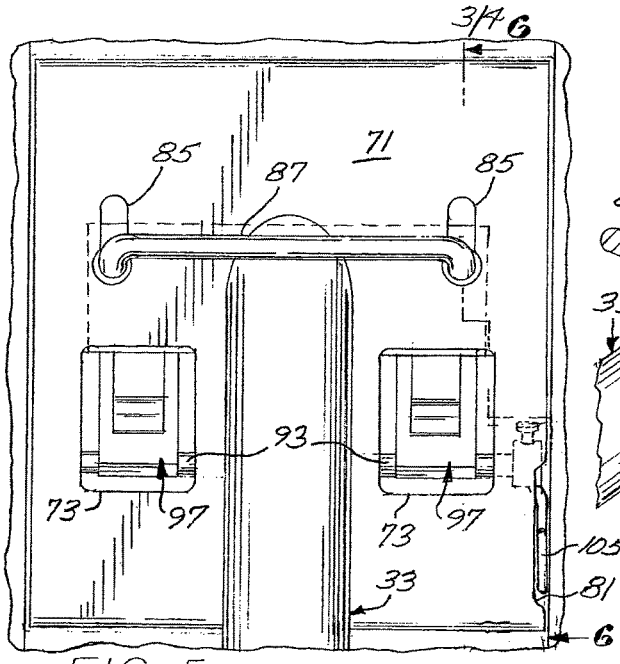
FIG. 5
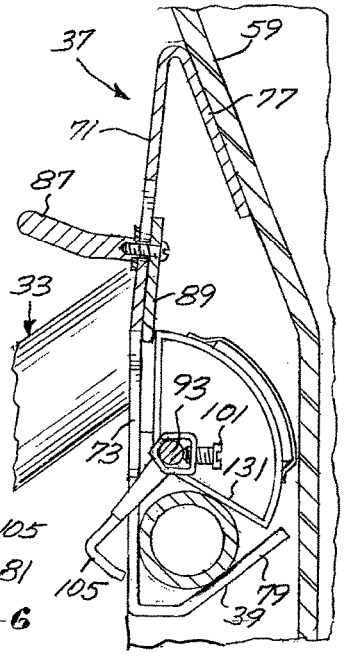
FIG. 6
FIG. 7
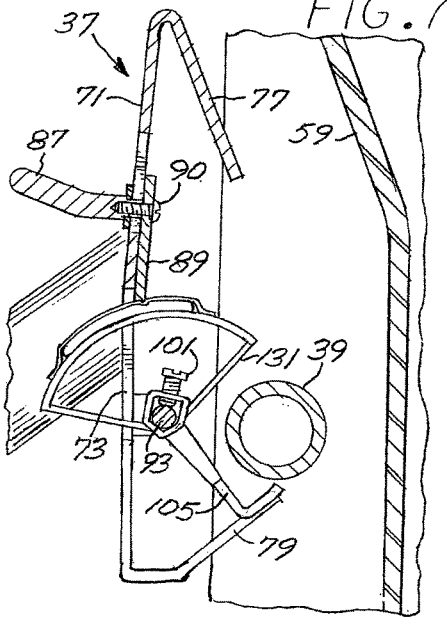
FIG. 8
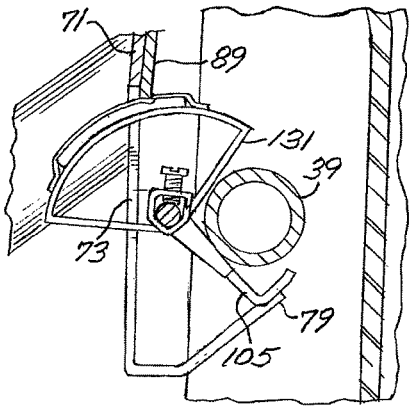

SEMI-AUTONOMOUS TUG APPARATUS

BACKGROUND

The present invention relates to robotic tugs such as might be used to maneuver trash cans or bins about.

DESCRIPTION OF THE PRIOR ART

In urban areas, each residential unit typically discards trash on a daily basis to a trashcan or bin which may be wheeled to the curb on a weekly basis for collection by the waste management department or other service. The task of moving the trash cans to the curb on the day trash is to be picked up can be a burdensome, particularly for any individual who may be suffering from any type of health issues making the task even more challenging.

In recognition of these issues, various attempts have been to provide for a motorized vehicle or the like to move the trash cans to the pickup location for Waste management or other trash pick-up service. It has been proposed to provide a motorized wagon, cart or wheeled sled for conveying trash cans to a location for convenient pickup. It has been proposed that these devices be guided by a path established by a guidewire or by a remote control device. Devices of these types are disclosed in U.S. Pat. No. 8,146,695 to Ramshur and in U.S. Application No. 2008/0038102 to Murphy. Such carts and sleds are relatively expensive, occupy considerable space and still require the homeowner to hoist the trash can on the cart or sled to be conveyed for trash collection.

Dedicated wheeled containers have been proposed with automatic lids for controlling the discard of trash. A device of this type is shown in U.S. Patent Application Publication No. 2007/0209846 to Wilson. Again, such dedicated containers are relatively expensive to manufacture and often not the style with which the collection service is familiar and are not readily adaptable to different methods of collection.

SUMMARY OF THE INVENTION

The present invention includes a housing flanked by a pair of wheels driven by reversible motors. The housing is balanced on the wheels to tilt to its back side and is supported there by a castor wheel. A controller is provided for receiving control signals to control the speed and direction of rotation of the motors. An elongated lifting arm is mounted from the top of the housing by a vertical swivel and angles laterally such that it can be swiveled to the vertical plane over castor wheel for supporting and the tug driven toward the front of the bin to engage a latch on the free end of the arm with a handle high on the bin, and the tug driven further toward the bin to tilt in backyard and raising the front of the bin and the castor off the support surface so that the remote can control the motors to tow the bin about.

The method of the present invention includes the steps of selecting a trash bin having a handle elevated on the front side and support wheels on the back side, selecting a self-propelled remotely controlled tug having a pair of support wheels supporting the tug housing and an upwardly and laterally angled arm, driving the tug support wheels independent of one another to steer the tug toward the bin to engage a support latch on the arm with the handle, tilting the top of the bin rearwardly while elevating the front side and latching the latch to the handle to hold the tug in position with the front of the bin raised off the support surface.

BRIEF DESCRIPTION OF THE DRAWINGS

FIG. 5 is a vertical, sectional view, in enlarged scale, taken along the lines 55 of FIG. 2;

FIG. 6 is a vertical, sectional view taken along the lines 6-6 of FIG. 5;

FIGS. 7 and 8 are vertical, sectional views similar to FIG. 6 but showing a latching device progressively engaging the handle on the trash bin;

DETAILED DESCRIPTION OF THE PREFERRED EMBODIMENTS

To be practical, we believe that a remote controlled tug for moving trash bins about must be economical to manufacture, sturdy and easy to operate. The device should be convenient to attach to a conventional trash bin without modification thereof and capable of moving about a residential trash bin loaded with, for instance, up to 200 pounds of trash.

Figure 1:
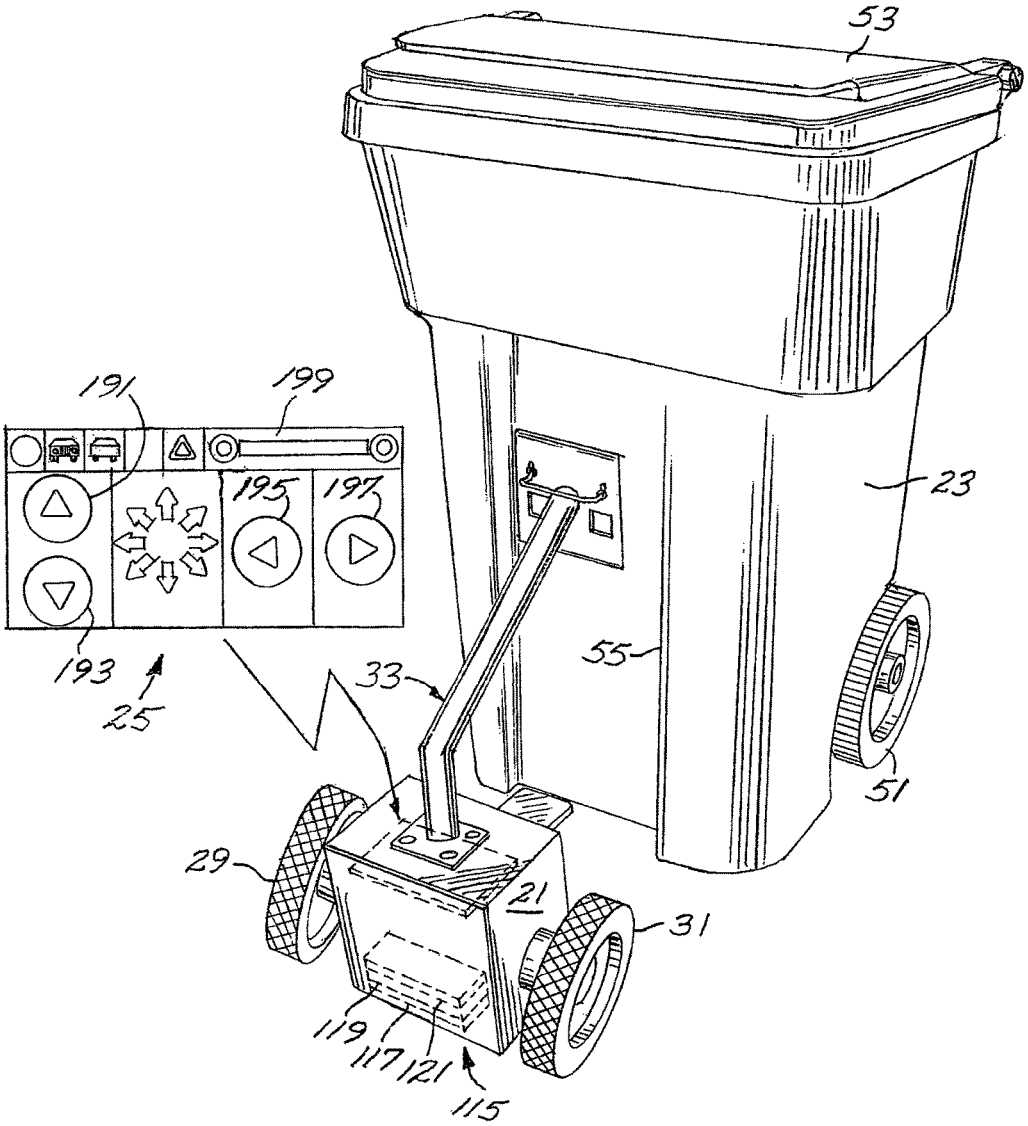
FIG. 1 is a perspective view of a tug of the present invention engaging a trash bin.
Figure 2:
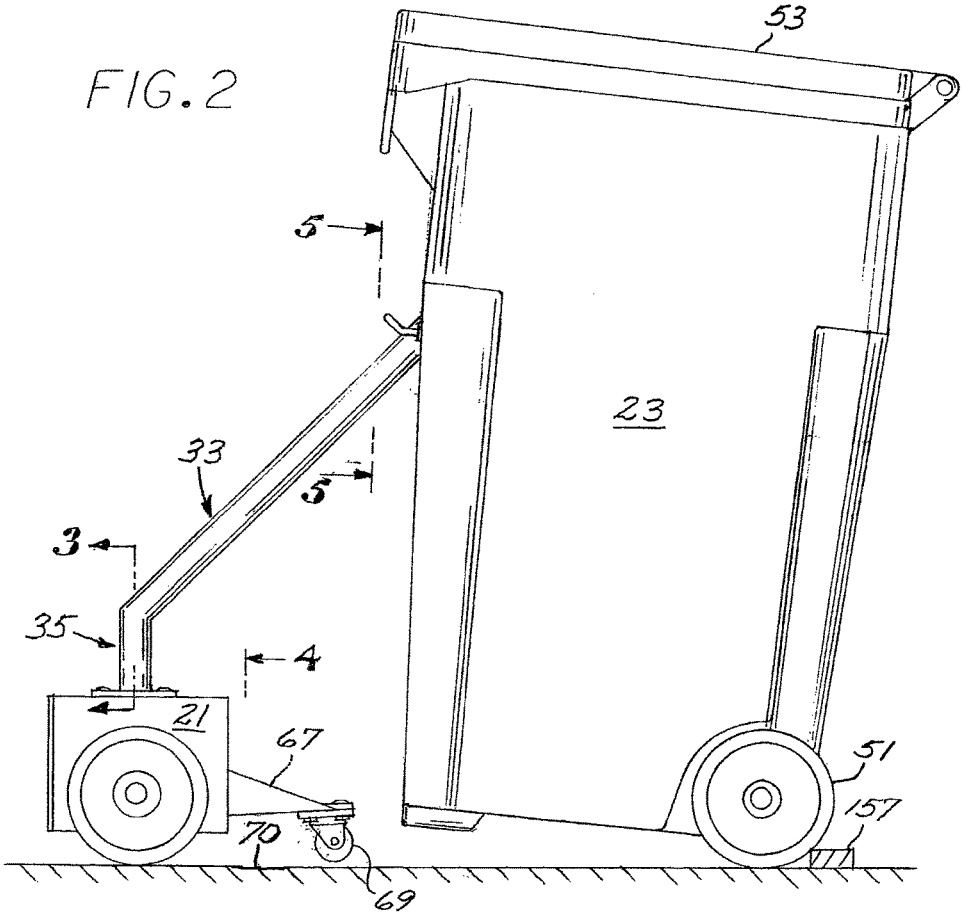
FIG. 2 is a side view of the tug shown in FIG. 1 maneuvering the trash bin about.

Referring the FIGS. 1, 2 and 6, the tug 21 of the present invention has particular utility for engaging and moving a trash bin 23 about a path dictated by a remote control 25. The tug 21 includes a housing 27 carried on a pair of independently driven, flanking drive wheels 29 and 31. The housing pivotally carries a support arm 33 from a vertical swivel 35 (FIG. 4) to project upwardly and laterally to carry a latch device 37 which engages a handle 39 in the bin 23. In practice, tilt the swivel rearwardly. This can be achieved by the angle of the swivel tilt rearwardly on the housing or maybe tilt the housing itself slightly downwardly and rearward at an angle of 3-9° to the horizontal so that the swivel device angles upwardly and rearwardly at an angle of about 3-9° to the vertical causing the pendulum action of the arm to as weighted at the top by the latch device 37 swing rearwardly of the housing 27.

Figure 3:
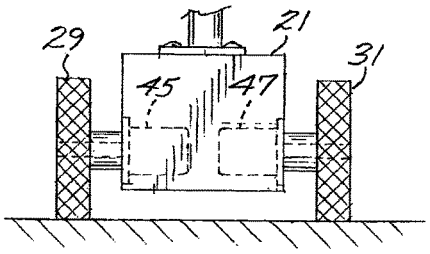
FIG. 3 is a front view of the tug shown in FIG. 1.

An advantage of the preferred embodiment is that, in operation the tug can maneuver about in tight turns to tow or direct the bin through a circuitous path having tight turns. To this end, we have constructed our tug 21 with a pair of reversible motors 45 and 47 (FIG. 3) to drive each of the wheels. For this particular application, we selected motors used in conventional Fisher-Price® Power Wheels for children's toys. The motors include 15 toothed sun gears having a standard spur gear, rotating at approximately 3200 rpm using a forced stage gear box producing an output rotation of 100 rpm thereby producing a 32:1 gear reduction. The output is coupled directly to the wheel with a coupling hub.

We constructed our tug particularly for use with a conventional trash bin 23 supported on its rear side by a pair of support wheels 51 and covered on its top side by a lid 53. The bin is similar to the unmodified bin as shown in U.S. Pat. No. 5,899,468 to Apps. The bin is formed on its front side with a vertically extending recess 55 which is formed at its upper extremity with an upwardly and forwardly projecting angled wall section 59 (FIGS. 6-8). In practice, the recess 55, and consequently the wall section, is typically about 8-10 inches wide.

Figure 4:
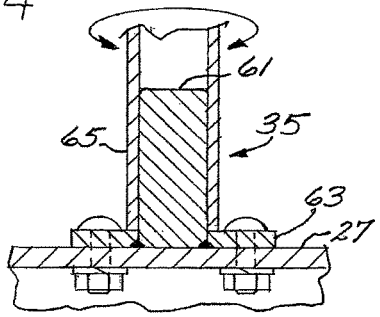
FIG. 4 is vertical, sectional view, in enlarged scale, taken along the lines 3-3 of FIG. 2.

Referring to FIG. 4, the swivel device 35 may be of any conventional construction, including a swivel incorporating a ball bearing, journals or the like. For the purpose of our exemplary embodiment, we merely depict the swivel device as a vertical stub rod 61 fixed to the top wall of the housing 27 by means of a fitting 63 and having the hollow base pipe section 65 of the arm 33 journaled thereover for rotation about a vertical axis. As mentioned, in one preferred embodiment this swivel angles upwardly and rearwardly to cause the arm to tend to assume a normal position extending rearwardly for ready latching as described below.

We found that a convenient angle for the body of the support arm 33 to project from the base section 65 is about 45° to the vertical. In practice, the arm will typically sway freely in pendulum fashion and, to the extent the swivel angles rearwardly, will tend to overhang the rear end of the housing 21.

The rearward end of the housing is supported by means of a rearwardly projecting foot 67 mounting a castor wheel 69 on the bottom side of the rearward toe.

Figure 9:
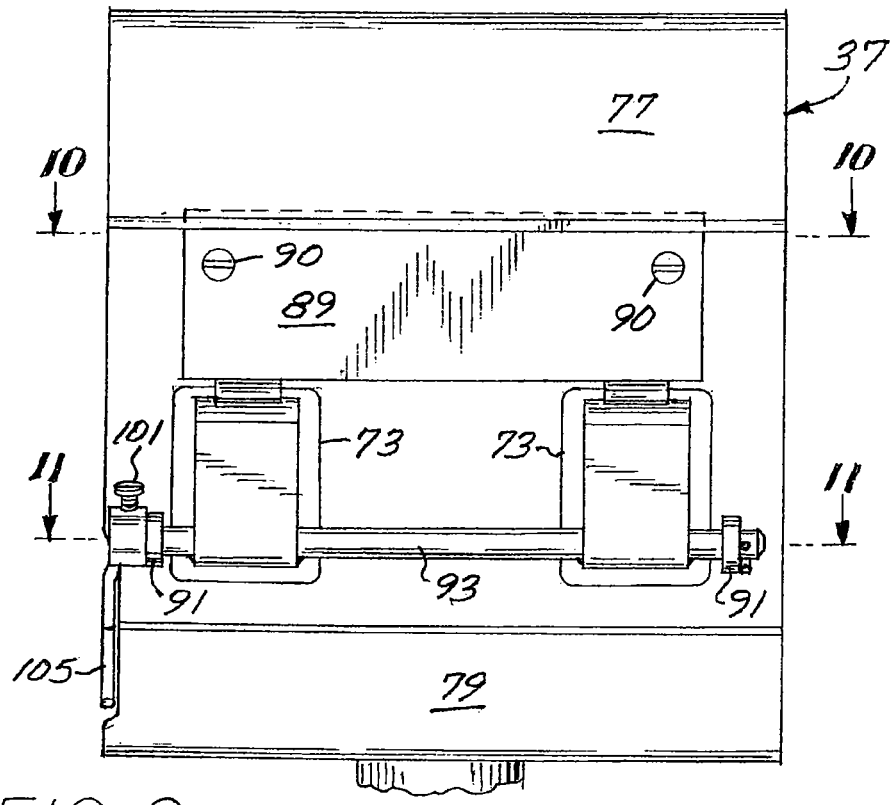
FIG. 9 is a front view of the latch shown in FIG. 7.
Figure 10:
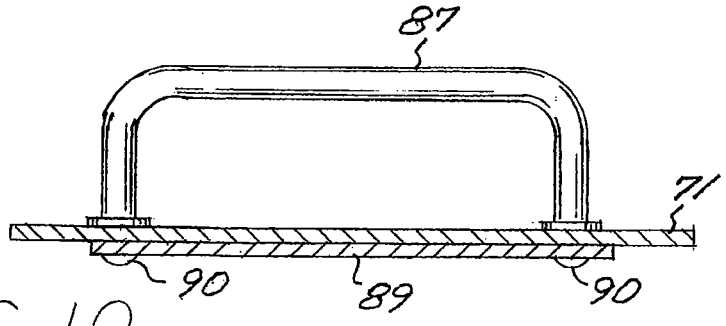
FIG. 10 is a horizontal, sectional view taken along the lines 10-10 of FIG. 9.

Referring to FIGS. 7-9, the latch device 37 includes a vertical front plate 71 carried from the free extremity of the support arm 33 and oriented in a generally vertical plane. The plate 71 is formed with a pair of laterally spaced apart windows 73. The plate is configured at its upper extremity with a downwardly and rearwardly angled pressure plate 77 angling at approximately 15° to the vertical to complement the angle of the wall section 59 of the trash bin. The front plate 71 is further formed at its bottom extremity with a rearwardly projecting catch plate 79 which angles upwardly and rearwardly at an angle of approximately 40° to the horizontal. In the preferred embodiment, the front plate 71, pressure plate 77 and catch plate 79 is 10 inches wide and the pressure plate 5 inches long to provide a pressure surface of 50 square inches for the even distribution of force over the wall of the bin when latching and lifting forces are applied thereto.

The front plate is formed along one side with a vertically extending clearance notch 81 (FIGS. 5 and 9).

The front plate is further formed above the windows 73 with a pair of laterally spaced apart vertical slots 85 for receipt of the opposite legs of a U-shaped handle 87 which slidably carries a keeper plate 89 disposed on the backside of the plate 71 to slide upwardly and downwardly along the back surface of such plate 71.

Figure 11:
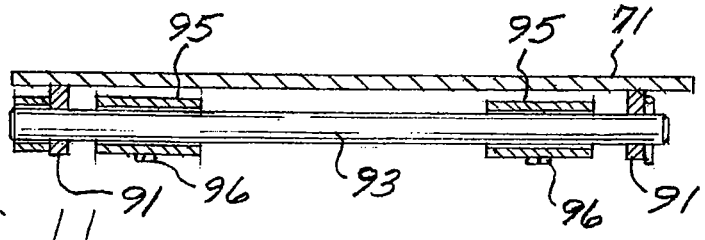
FIG. 11 is a horizontal, sectional view taken along the lines 11-11 of FIG. 9.

Referring the FIGS. 9 and 11, mounted to the backside of the front plate 71 are a pair of laterally spaced apart brackets 91 having bores therein through which a control rod 93 is journaled. Carried medially on such rod are a pair of stub tube fittings 95 locked in place by representative set screws 96. The rod mounts the apex of the pie shaped angular latches 97 spaced apart thereon. Such latches are configured with a general pie shape for rotating back and forth from latching to an unlatching position. The rod 93 is constructed to rotate the latches 97 clockwise from an unlatched position as shown in FIG. 7 to the latching position shown in FIG. 6. Mounted on one end of the rod 93 is an actuator hook 105 having a set screw 101 through its hub to secure the hook in the desired clocked position relative to the rod 93. The actuator hook 105 is configured to, when the tug is moved into position, contact the handle 59 as shown in FIG. 8, rotate the rod, clockwise as viewed in FIGS. 7 and 8 to the position shown in FIG. 6.

Referring to FIGS. 6-8, the latches are pie shaped to form a little over a quadrant of a circle and include respective pairs of radial spokes 131 carried on their converged radial inner ends from the respective tube segments 95. Respective sectors of cylinders define rims 133 carried on opposite ends from the respective spokes 131. The rims mount on their respective radial outer surfaces elongated arcuate cams 137 having respective sloped riser sections 139 and 141 at the opposite ends thereof for co-acting with the lower edge of the keeper plate 89.

As will be appreciated by those skilled in the art, the keeper plate 89 (FIGS. 6 and 7) is configured to be slid from an upper, retracted position shown in FIG. 7 to the lowered keeper position shown in FIG. 6 engaged behind respective one ends of the latches to block the latches against rotation counter clockwise from the latching position shown in FIG. 6.

We devised a control system 115 (FIG. 1) responsive to the remote control 25 for controlling the direction of rotation and speed of rotation for the respective wheels 29 and 31. While many different control systems are known in the art for this purpose, we selected a microprocessor 117 (FIG. 1) without a feedback control system in the form of an Arduino® UNO R3 principally because of its relatively inexpensive selling price and simplicity of programming. The lack of feedback leaves the operation with no sense of orientation of the wheels at any point in time. Another benefit of the Arduino® is that it is based on a limited set of functions for standard C/C++ programming code where the code is uploaded from the Arduino® integrated development environment (IDE) into a C/C++ compiler.

For other embodiments of our invention we would select a microprocessor capable of sensing the orientation of the wheels so that adjustment could be made as desired. This type of feedback control would provide the benefit that the tug could be controlled to turn the trash bin and straighten it out to move it in a straight line with minimal manual controls from the remote 25.

In our preferred embodiment we selected the independent motors 45 and 47 and utilize a differential steering technique with an h-bridge device to reverse the polarity of such motors to control movement, the drive rotation forward and backwards as desired. To achieve this, we selected a motor controller 119 (FIG. 1) in the form of a Polou® VNH5019 motor controller shield which is capable of handling up to 12 amps of continuous current which has proven sufficient for our stall torque of 7 amps per motor. We selected this shield for simplification purposes to make a breadboard unnecessary. With this arrangement, the only components needed to control the system are the power sources, the Arduino® micro controller and a motor shield 121 in the form of a Bluetooth® shield.

We selected this Bluetooth® technology because of its versatility and ease of connection to the system. Particularly, we selected a Bluefruit® EZ-Link Shield 121 to be conveniently stacked on the Arduino® board to serve as a regular SPP serial link client device to be paired with any computer or tablet to appear as a serial/COM port (except iOS as iOS does not permit SPP pairing). This combination provides for effective control by a remote controller 25 in the form of a cellphone running Android® software.

In practice for the remote control 25, we utilized a smart phone employing the "Arduino® Bluetooth RC Car" application available on Googleplay® for Android® devices. This provides the benefit that it features a forward, backward, right, left and a bar to control speed. We found this arrangement could be easily programmed using the Arduino® by setting the forward button 191 (FIG. 1) to control both motors in the forward direction and backward button 193 to cause both motors to reverse, left button 195 to control the speed of the right hand wheel 31 and then the left wheel 29 and vice versa for the right hand button 197.

In operation, it will be appreciated that the tug of the present invention may be utilized with many different conventional trash bins 23 and may be readily modified to latch onto bins of different configurations without departing from the spirit of the invention. With respect to the preferred embodiment, it will be appreciated that the tug will function with different trash bins utilized by residents or businesses to catch quantities of trash to be taken to the trash collection point at the curb or elsewhere on trash collection day.

In that regard, the bins 23 may be stored in or adjacent to the user's garage area or alongside the house or other convenient locations for deposit of trash on a daily basis through the lid 53. Then on trash collection day, the home owner may conveniently operate the remote control 25 (FIG. 1) to rotate the respective wheels 29 and 31 at the desired rate of rotation and speed to steer the tug to the location of the first bin 23 to be maneuvered to the curb. In that regards, the buttons 191-197 might be actuated to control the rotation of the respective wheels 29 and 31 and the bar 199 actuated to control the desired speed.

The tug is conveniently supported on the drive wheels 29 and 31 and the castor wheel 69 so that the castor wheel will pivot as the tug is moved about to maneuver the latch device 37 into proximity of the handle 39 of the bin. As the tug is moved about, it will be appreciated that the support arm 33 tends to angle upwardly and rearwardly under the influence of gravity to be disposed over, and in the same vertical plane, as the foot 67 supported by the castor wheel 69 so that the operator can direct the latch device into the recess 55 at the approximate level of the sloped wall section 59 (FIGS. 6 and 7).

The tug will be moved into position to direct the latch device into the upper portion of the recess 55 in the front wall of the bin FIG. 7), it being appreciated that the keeper plate 89 is held in its retracted position by the cams 133. As the tug maneuvers the latch device into the recess 55 at the approximate level of the handle 39, the actuation hook 105 will be engaged with the handle 59 such that continued travel of the tug in the rearward direction will cause the handle 59 to rotate the hook 105, and consequently the rod 93 and latches 97. As clockwise rotation of the latches continues the leading spoke 131 will engage the handle 59 such that continued rearward travel of the tug and consequent rotation of the latches will lift the latch devices upwardly and rearwardly in the recess 55 to engage the catch plate 79 with the rearward, lower quadrant of the handle 39 directing the handle into the nest formed between such hook and the back side of the front plate 71. Concurrently, the back plate 71 is lifted upwardly and rearwardly to firmly engage the pressure plate 77 with the sloped wall section 59 (FIG. 6) to provide a positive, secure support with the forces of the mechanism distributed across the surface of the sloped wall 59 to thereby afford support against puncture of that wall as forces are applied thereto during further maneuvering. As described below, the rearward travel of the tug relative to rear support wheels 51 of the bin during this latching procedure serves to tilt the tug a few degrees counter clockwise on its wheels 29 and 31 serving to lift the castor wheel 69 off the support surface 70.

As clockwise rotation of the respective latches 97 is completed as dictated by the actuation arm 105, the cams 137 and then the counterclockwise extent of the respective pie shaped latches 97 will clear the bottom edge of the keeper plate 89 to free such keeper plate to drop downwardly under the influence of gravity to the position shown in FIG. 6 to lock the respective latches 97 in their latching positions for secure attachment and convenient maneuverability of the bin 23.

We have discovered that in some instances it is beneficial to place a block 157 (FIG. 2) behind the support wheels 51 to block rearward rotation thereof as the latch devices 37 are maneuvered into position such that the rearward travel of the tug relative to the support wheels 51 causes the arm 33 and thus the tug housing 21 to be rotated a few degrees counter clockwise. Such a rotation on the order of 4°-12°, and preferably 9°, is sufficient to tilt the housing 27 counterclockwise with the foot 67 to raise the castor wheel 69 about a quarter inch off the support surface. Then, with the latches firmly in position and the keeper plate 89 in place as shown in FIG. 6, the orientation between the rearwardly sloped trash can 23 and the control arm 33 will be maintained fixed to thus to maintain the castor wheel 69 elevated to enhance the maneuverability of the tug and support wheels of the trash bin as the drive wheels 29 and 31 are rotated at different speeds or in different directions to maneuver the tug and trash bin about supported on essentially four wheels to travel either in a forward or rearward direction, or some combination thereof, or even pivoting in place with the support arm swiveling on the swivel 35. With this high degree of maneuverability, we have demonstrated that the subject tug, latched to the bin, can easily be maneuvered about to steer the bin through straight or circuitous paths, either frontward or backward, thus simulating a path which might be encountered in practice.

With this arrangement, the tug and bin essentially have a 4 point support on the bin wheels and the tug power wheels so that, for instance, as the tug tows the bin, it can be pivoted about under the swivel to be directed at different directions with the support arm pivoted into place by the drag of the weight of the bin, angled toward the bin, irrespective of the orientation of the tug housing. With this maneuverability, the bin may be towed though tight circuitous paths making sharp turns and even being pivoted on its own vertical axis to be towed around various obstacles.

When it is desirable to detach the tug from the trash bin 23, an operator can merely grasp the keeper handle 87 and raise the keeper plate 89 to free the respective latch devices 97 to rotate counterclockwise through the positions shown in FIGS. 7 and 8 to free the latch device from the handle 59 and allow the tug housing to rotate a few degrees clockwise to lower the foot 67 and distribute the weight thereof between the drive wheels and such castor wheel. The tug may then be maneuvered about clear of the trashcan 23 for access by waste management or other trash collection services.

In some embodiments, we incorporate a remotely controlled solenoid for lifting keeper handle 87 so detachment may be achieved from a remote location.

While some embodiments of our tug will employ full autonomous constructions, it will be appreciated from the foregoing that this semiautonomous tug provides a relatively inexpensive and fool proof mechanism for hitching to conventional bins and conveniently maneuvering them to a collection area.

By taking advantage of the exposed handle on conventional trash bins for the latching attachment, our tug apparatus has the advantage of being noninvasive and can readily latch to conventional bins without modification.

In some embodiments, our tug employs proximity sensors to guide the tug away from obstacles and prevent impingement on obstacles such as buildings and vehicles.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. A semi-autonomous tug apparatus for latching to a handle on a front side of a bin supported on the opposite back side by support wheels and comprising:

a housing having front and back sides and a foot projecting rearwardly from the back side to form a toe;

a pair of drive wheels supporting the housing;

a castor wheel mounted on the toe;

reversible drive motors coupled to the respective drive wheels for driving the wheels independent of one another;

a control device for controlling the motors an including a controller;

an elongated lifting arm having first and second ends;

a swivel mounting the first end of the lifting arm from the housing to project the arm upwardly and laterally to the height of the handle;

a latch device on the second end for latching to the handle; and the housing, arm and latch device being so configured and constructed to, when the latch device is latched to the handle, hold the castor wheel elevated from the support surface.

2. The semi-autonomous tug apparatus of claim 1 wherein:

the latch device includes a keeper device to keep the lath device latched to the handle.

3. The semi-autonomous tug of claim 1 for towing a bin having a front wall formed with a vertically extending recess having an upper extremity formed with a forwardly and upwardly inclined wall section and the handle mounted there-below, and wherein:

the latch device includes a downwardly and rearwardly inclined pressure plate for engaging the wall section and the latch device is so configured and arranged as to latch on the handle with the pressure plate engaged against the wall section.

4. The semi-autonomous tug apparatus of claim 3 that includes:

a keeper operable to engage the latch device to hold it latched to the handle.

5. The semi-autonomous tug apparatus of claim 3 that includes:

an actuator carried from the latch device to, upon such latch device being moved rearwardly into position adjacent the handle, engage the handle and as the latch device continues rearward travel, rotating the latch device to latching to the handle.

6. The semi-autonomous tug apparatus of claim 3 wherein:

the latch device includes a vertically extending front plate formed with a window and configured at its bottom extremity with an upwardly and forwardly projecting catch cooperating with the front plate to define a nest for receipt of the handle; and the latch device is in the form of a triangular latch element having an apex pivotally mounted from the front plate adjacent the window and further formed with an arcuate section arranged to be at least partially retracted through the window to a retracted position and to rotate forwardly from the window to a latching position holding the handle captive in the nest.

7. The semi-autonomous tug apparatus of claim 6 that includes:

an actuator hook configured to, when the latch device is moved in one direction toward the handle, engage the handle causing the latch device, as movement in the one direction of the front plate continues, cause the latch element to rotate from a retracted position to the latching position.

8. The semi-autonomous tug apparatus of claim 7 that includes:

a keeper mounted on the front plate and shiftable to a keeper position keeping the latch device latched to the handle.

9. The semi-autonomous tug apparatus of claim 1 wherein:

the drive wheels are disposed on a transverse axial line;

the swivel mount is mounted in vertical alignment over the axial line; and the castor wheel is spaced rearwardly of the drive wheels.

10. A semiautonomous trash bin tug for maneuvering a trash bin of the type including a pair of rearwardly disposed support wheels supported on a support surface and a front wall including a horizontal handle and comprising:

a housing supported on a pair of drive wheels and including a rearwardly projecting foot riding on a castor wheel;

a pair of motors coupled to the respective drive wheels;

a support arm pivotally carried from the housing and angling upwardly and laterally to form a free end;

a latch device mounted on the free end and including a vertically disposed front plate formed with a window and configured at its upper extremity with a rearwardly turned, downwardly angled pressure plate for engaging the front wall and further configured at its bottom extremity with a rearwardly and upwardly sloped catch plate cooperating with the front plate to form a nest;

a latch element pivotally mounted from the front plate for rotation in one direction to a release position projecting at least partially through the window and in the opposite direction to a latch position to capture the handle in the nest and block egress therefrom;

an actuator coupled with the latch element to, upon the latch device moving rearwardly to approach the handle, engage such handle and on continuing rearward travel of the latch device, to rotate the latch element in the one direction to the latch position; and a keeper plate on the front side of the front wall carried slidably therefrom to slide from a retracted position elevated above the window to a keeper position projecting downwardly in confronting relationship with the window to block travel in the one direction of the latch element.

11. The semiautonomous trash bin tug of claim 10 wherein:

the support arm and latch are so arranged and constructed that the drive wheels may be rotated by the motors to drive the latch device rearwardly into engagement with the handle and continued travel of the housing in the rearward direction without the support wheels rotating will cause the trash bin to be tilted upwardly and rearwardly and also rotate the housing to an elevating position and to raise the toe upwardly to raise the castor wheel off the support surface and, as the latch device is rotated to the latching position maintain the housing in the elevating position to hold the castor off the support surface.

* * * * *